US006651861B2

(12) United States Patent
Raffoni

(10) Patent No.: US 6,651,861 B2
(45) Date of Patent: Nov. 25, 2003

(54) APPARATUS FOR FEEDING STAPLING ELEMENTS TO A STAPLING MACHINE SUITABLE TO JOIN STRIPS AT AN ANGLE

(76) Inventor: Giuseppe Raffoni, Via D. Bolognesi, 24, 47100 Forli' (IT)

( * ) Notice: Subject to any disclaimer, the term of this patent is extended or adjusted under 35 U.S.C. 154(b) by 10 days.

(21) Appl. No.: 09/775,467

(22) Filed: Feb. 5, 2001

(65) Prior Publication Data

US 2001/0013530 A1 Aug. 16, 2001

(30) Foreign Application Priority Data

Feb. 14, 2000 (IT) ..... B02000A0061

(51) Int. Cl.[7] ..... B25C 5/02

(52) U.S. Cl. ..... 227/120; 227/148; 227/154; 227/109; 227/107

(58) Field of Search ..... 227/120, 148, 227/151, 154, 109, 107

(56) References Cited

U.S. PATENT DOCUMENTS

| | | | | |
|---|---|---|---|---|
| 3,228,580 A | | 1/1966 | Washington et al. | |
| 3,670,941 A | * | 6/1972 | Grinnell et al. | 227/110 |
| 4,572,420 A | * | 2/1986 | Pistorius | 227/110 |
| 4,732,309 A | * | 3/1988 | Judge | 227/109 |
| 4,830,257 A | * | 5/1989 | Lin | 227/152 |
| 4,876,787 A | * | 10/1989 | Ditty et al. | 227/103 |
| 5,065,930 A | * | 11/1991 | Kennedy | 227/114 |
| 5,322,189 A | * | 6/1994 | Oda | 221/227 |
| 5,556,020 A | * | 9/1996 | Hou | 227/109 |
| 5,615,819 A | * | 4/1997 | Hou et al. | 227/109 |
| 5,758,812 A | * | 6/1998 | Raffoni | 227/107 |
| 5,816,467 A | * | 10/1998 | Dunn | 227/140 |

FOREIGN PATENT DOCUMENTS

| | | |
|---|---|---|
| FR | 2 525 949 | 11/1983 |
| FR | 2 609 925 | 7/1988 |
| GB | 2 279 284 | 1/1995 |

* cited by examiner

*Primary Examiner*—Stephen F. Gerrity
*Assistant Examiner*—Louis Tran
(74) *Attorney, Agent, or Firm*—Guido Modiano; Albert Josif; Daniel J. O'Byrne

(57) ABSTRACT

An apparatus for feeding stapling elements grouped in sets to a stapling machine which is suitable to insert the elements astride the joint of strips arranged at an angle in order to provide perimetric frames, supporting frames and the like, comprising a magazine which is composed of at least one inclined channel suitable to accommodate a plurality of aligned sets and having a downward outlet for the sets, means for individually releasing the sets from the at least one channel through the outlet, a holder which comprises at least one seat arranged below the outlet of the at least one channel, actuators for actuating the holder between a position for receiving a set from the at least one channel in the at least one seat and a position for positioning the set with respect to the stapling machine so as to align the punch of the machine with the stapling elements to be inserted.

13 Claims, 7 Drawing Sheets

1a
4
4
5
38
10
39
52
53
C
14
15
42,45
X
X
Y
Y

APPARATUS FOR FEEDING STAPLING ELEMENTS TO A STAPLING MACHINE SUITABLE TO JOIN STRIPS AT AN ANGLE

BACKGROUND OF THE INVENTION

The present invention relates to an apparatus for feeding stapling elements to a stapling machine suitable to join strips at an angle, in order to form perimetric frames, supporting frames and the like.

In stapling machines for forming perimetric frames and supporting frames, the strips are arranged at an angle and are joined one another by means of stapling elements which are constituted by staples, contoured plates and the like generically known as metal stapling members or staples.

The metal stapling members or staples are grouped so as to form a set which is accommodated in a holder. By means of an appropriately provided pusher which acts on the set, the stapling members are pushed out of the holder and arranged above a punch which is actuated by a pneumatic cylinder and inserts them astride the connecting line of two strips arranged at an angle.

It has been observed that the capacity of said holders is insufficient, and it is therefore necessary to frequently perform refilling, thereby interrupting the production cycle.

SUMMARY OF THE INVENTION

The aim of the present invention is to provide an apparatus which allows to feed the metallic stapling members to the stapling machine so as to ensure long operating periods without refilling.

Within the scope of this aim, an object of the present invention is to provide an apparatus which allows to feed metallic stapling members of different kinds in terms of dimensions and format, selected by the apparatus according to the type being required.

This aim and this object are achieved with an apparatus whose characteristics are defined in the appended claims.

BRIEF DESCRIPTION OF THE DRAWINGS

Further characteristics and advantages will become better apparent from the following description of an embodiment in which the apparatus is combined with a frame assembling machine.

In the accompanying drawings.

DESCRIPTION OF THE PREFERRED EMBODIMENTS

Figure 1:
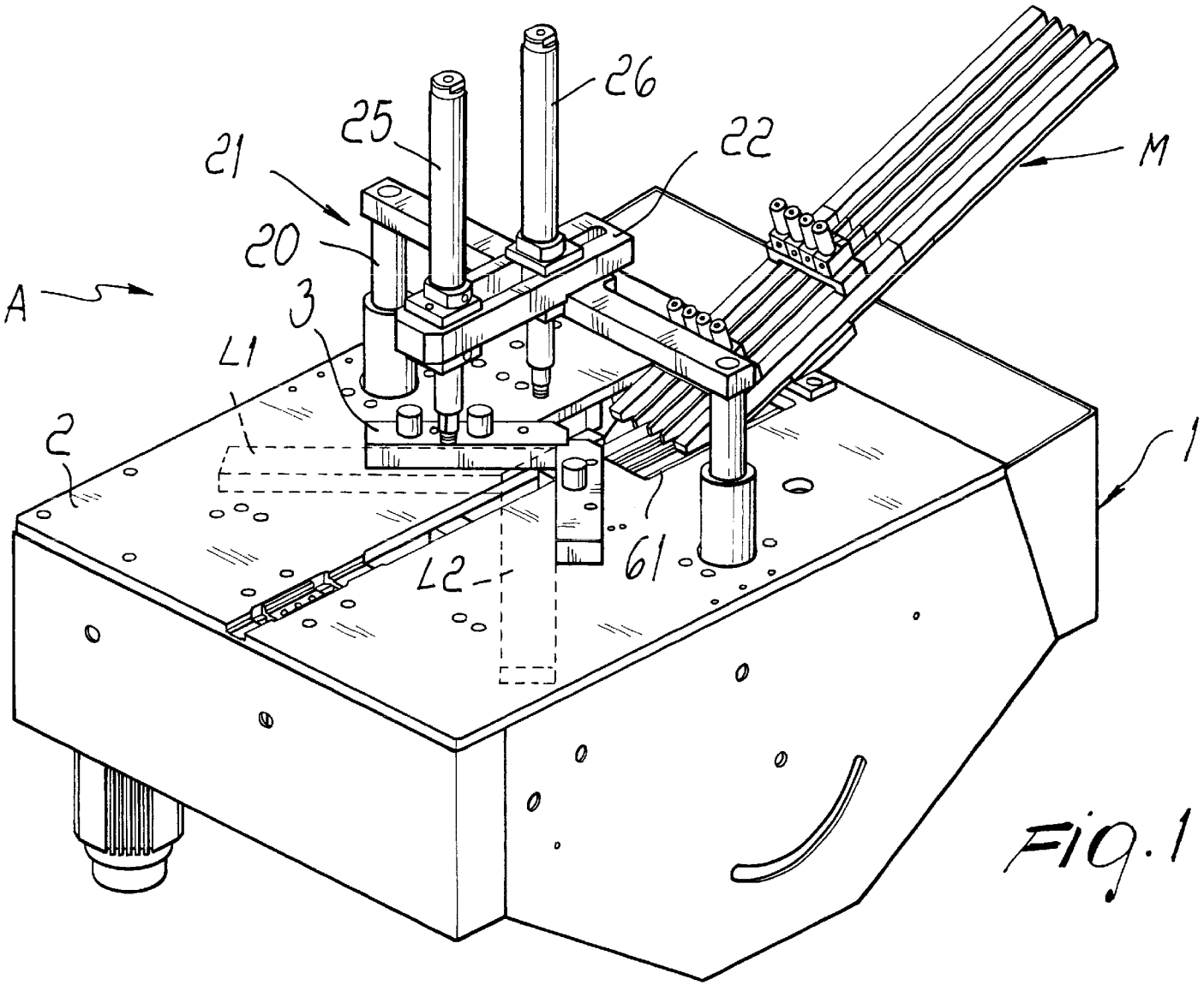
FIG. 1 is a perspective view of a frame assembling machine provided with the apparatus according to the invention.

With reference to the figures, the reference letter A generally designates an assembling machine comprising a footing 1 provided with a worktable 2 on which there is an L-shaped element 3 for arranging at right angles two strips L1 and L2 in order to form a frame. The ends of the strips L1 and L2 are cut at 45° and are arranged side by side on a coupling plane which divides in half the angle enclosed by the two strips.

Two parallel bars 4 are fixed under the worktable 2, between two shoulders 1*a* and 1*b* rigidly coupled to the sides of the footing 1, and constitute guides for the sliding of a carriage 5 which can be positioned along the guides by means of a reversible motor 6. The motor 6 is fixed to the footing 1, and its output shaft 7 is threaded in order to engage by screwing in a bracket 8 of the carriage 5.

The shaft 7, turned by the motor 6, allows to move the carriage 5 in both directions X—X.

Below the carriage 5 there is a stapling machine or stapling head of a known type, generally designated by the reference numeral 9.

Said head 9 comprises a cylinder 10 having a vertical axis and inside which a piston 12 can move; said piston is provided with a stem 13 which protrudes upwards and ends with a striking punch 14 for firing the metallic stapling members, particularly for joining at an angle the two strips L1, L2 that form the frame.

The striking punch 14 is guided in a firing channel which lies within the head 15 of the stapling machine 9. The head 15 is slideable along a through slot 16 of the worktable 2 which is parallel to the direction X—X and is preset to receive and position, in alignment with the punch 14, the metallic stapling members for joining the strips. The L-shaped element 3 is fixed on the worktable 2 so that the coupling plane of the strips L1 and L2 in abutment against the L-shaped element is aligned with the slot 16.

A fluid-actuated or pneumatic actuator 17 is further installed below the worktable 2 and is composed of a cylinder 18 fixed below the worktable 2 and in which a piston 19 slides along the direction Z—Z. The stem of the piston 19 acts on a pair of columns 20 which rise above the worktable 2 and support a device for locking the strips on the worktable 2, generally designated by the reference numeral 21 and composed of an arm 22 which cantilevers out from the top of the column 20 to which it is fixed and includes guiding means for a pair of sliders 23 and 24.

Two fluid-actuated jacks 25 and 26 are fitted on the sliders 23 and 24; their stems 27 and 28 protrude downwardly under the arm 22 and support, at their lower end, respective pads 29 and 30.

Respective threaded shafts 31 and 32 are engaged by screwing in the sliders 23 and 24 and can be actuated by a pair of motors 33 and 34 so as to allow the sliders 23 and 24 to move along the respective guides independently of each other. By way of conventional devices for detecting the cross-section of the strips L1 and L2 (which are not shown, since they are not pertinent to the present invention), the motors 33 and 34 are actuated so as to move the pads 29 and 30 into the intended positions for locking the strips L1 and L2. At the same time, the motor 6 is actuated so as to move the carriage 5 and therefore the stapling machine 9 into the positions in which the metallic stapling members are to be inserted astride the joint of the strips L1 and L2.

The firing channel of the metal stapling members that lies within the head 15 has a cross-section which is complementary to the shape of said stapling members.

It is assumed hereinafter that the metallic stapling members are constituted by laminar staples, designated by the reference letter G, having a W-shaped cross-section and being joined so as to form sets S of preset length. The staples G are fed in sets S from a magazine which is described in greater detail hereinafter and is generally designated by the reference letter M. In order to arrange the staples G in the head 15, such head has, parallel to the firing channel 35 of the punch 14, two grooves 36 and 37 which are arranged at the sides of the channel 35. The grooves 36 and 37 have outer walls, with respect to the channel 35, which converge towards the centerline plane of the head 15.

Figure 5:
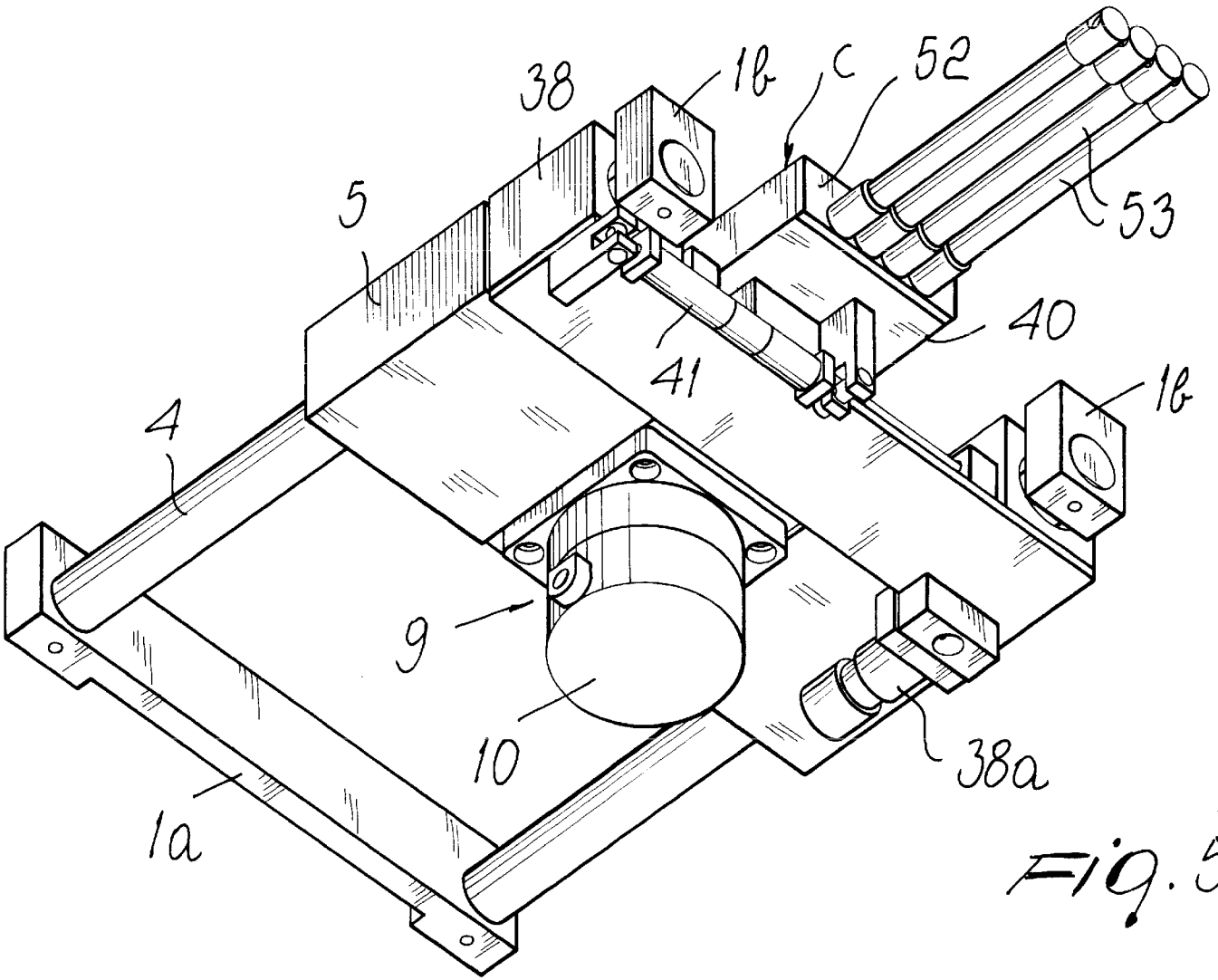
FIG. 5 is a bottom perspective view of the mechanism shown in FIG. 4.

A slider 38 can further slide on the guides 4, between the carriage 5 and the shoulder 1*b;* with respect to the carriage 5, said slider can move by means of a jack 38*a* (see FIG. 5) in which the cylinder is mounted below the carriage 5 and the stem is rigidly coupled below the slider 38.

Figure 8:
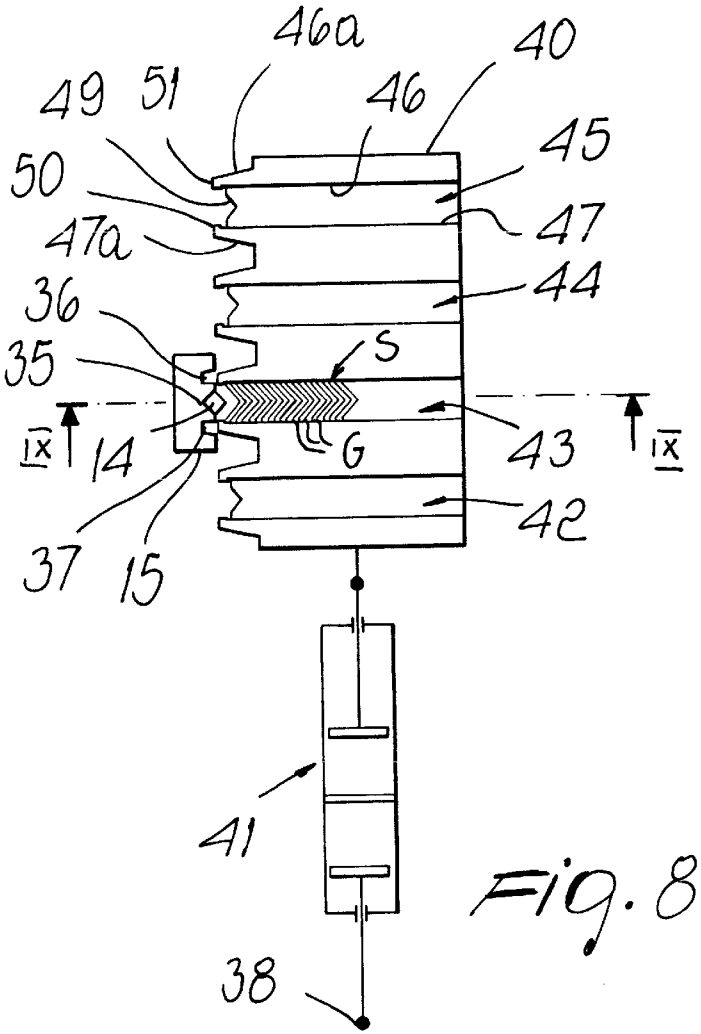
FIG. 8 is a schematic plan view of the means for positioning the metal stapling members on the stapling machine.

Two bars 39 are arranged above the slider 38, are perpendicular to the guides 4 and constitute guides for a sliding block 40. The sliding block 40 can be positioned along the guides 39 by means of a jack 41 composed of two cylinders arranged in series (see FIG. 8), in which the stems are respectively rigidly coupled to the slider 38 and to the sliding block 40 so as to move said sliding block in the direction Y—Y which is perpendicular to the direction X—X of the carriage.

Four seats 42, 43, 44, 45 are formed in the sliding block 40, are open upward and are designed to receive the sets S of stapling members G. Said seats 42–45 are shaped complementarily to the set S that they must contain. In particular, the seats 42–45 can have a rectangular cross-section which has the same width but increases in height from the seat 42 to the seat 45 so as to allow the insertion therein of sets S composed of stapling members of increasing height.

Each seat 42–45 (see FIG. 8) has two flat and parallel walls 46 and 47, which form a channel, and a bottom 48. At the end that is directed towards the head 15, the bottom 48 has a recess 49 which is mirror-symmetrical with respect to the channel 35. The walls 46 and 47 protrude beyond the recess 49, forming extensions 46*a*, 47*a* which have converging outer faces and ends which are folded towards each other so as to form mutually opposite claw-shaped shoulders 50 and 51.

Figure 4:
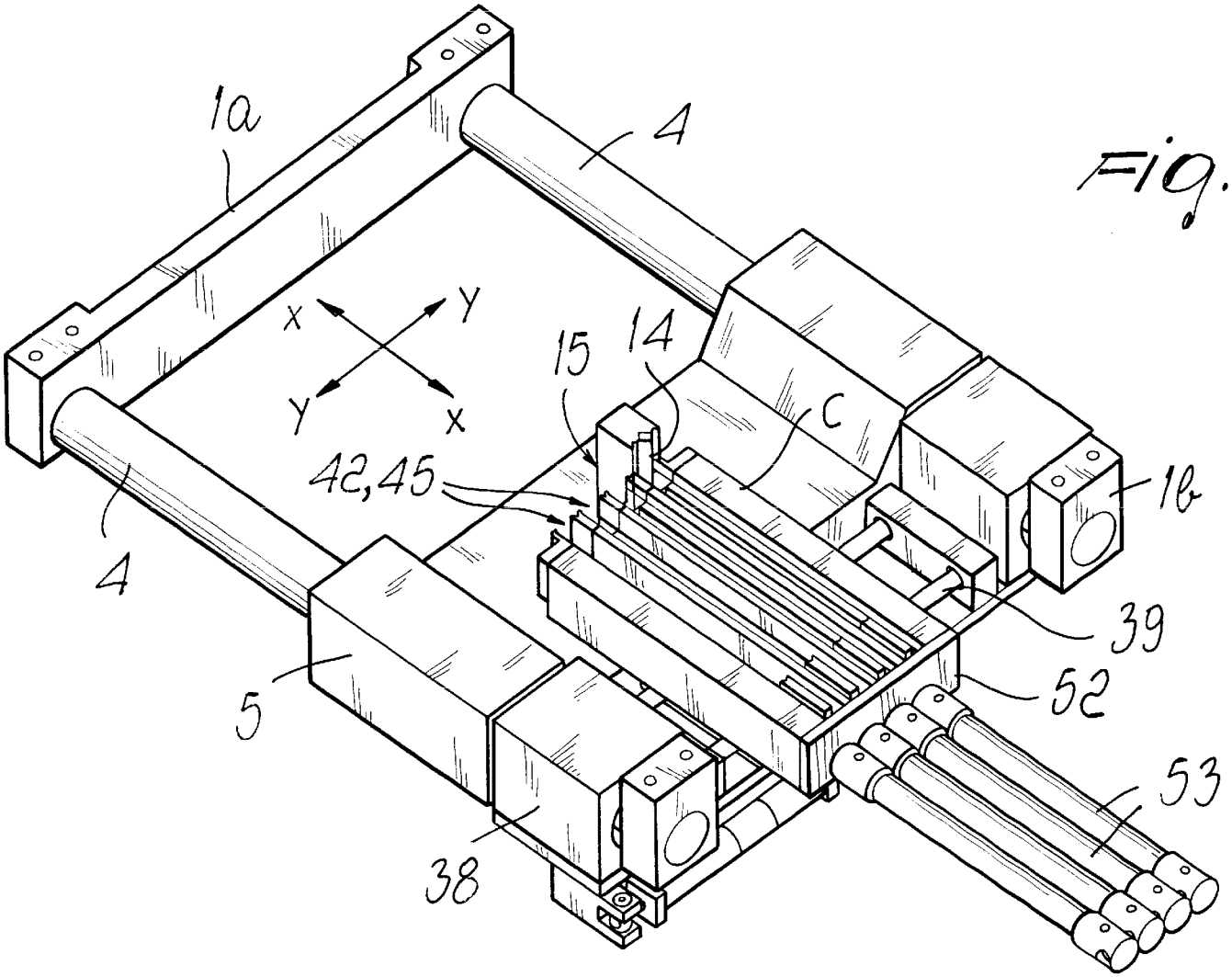
FIG. 4 is a top perspective view of the internal mechanism of the apparatus.

A flange 52 is rigidly coupled to the sliding block 40, at the end that lies opposite the recesses 49 (see FIGS. 4 and 5), and stapling member pusher elements 53 are fixed to said flange in alignment with the seats 42–45. The stapling member pusher elements 53 are constituted, for example, by pneumatic cylinders which cantilever out from the flange 52 and act on the sets 5 arranged in the seats 42–45, keeping them in abutment against the shoulders 50, 51.

In practice, the sliding block 40, with the seats 42–45, the jack 41 for Y—Y transverse movement and the jack 38*a* for X—X axial movement constitute a holder C which allows to supply the stapling machine 9 with staples G to be fired.

In order to supply in turn the holder C with sets S of staples G, there is a magazine, generally designated by the reference letter M, which is composed of an inclined surface 54 being fixed, by means of a bracket 54*a*, to the worktable 2 behind the L-shaped element 3.

A plurality of parallel shoulders 55 are arranged on the inclined surface 54 and form multiple channels 56 which are open upwardly. The channels 56 have a bottom 57 spaced from the surface 54, so as to form an interspace 58 which is connected to a source of compressed air which enters it through an inlet 59 of the surface 54 in order to facilitate the descent of the sets S. The compressed air exits from the interspace 58 into the channels 56 through a plurality of passages 60 which are orientated towards the descending side of the surface 54.

The lowermost portion of the shoulders 55 and of the inclined surface 54 passes through an opening 61 of the worktable 2 (see FIG. 1), so that the lower ends of the channels 56 lie above the seats 42–45 of the holder C.

The sets S of staples G to be fed into the holder C are deposited in the channels 56. The sets S are deposited one at a time by means of a singling-out device composed of a first series of retention elements 62 which are arranged at the outlet of the channels 56 and by a second series of locking elements 63 which are spaced from the elements of the first series. The distance of the retention elements 62 from the locking elements 63 is such that when the former release the set that is closest to the outlet of the channels 56, the second elements lock the immediately subsequent set.

Figures 6, 7:
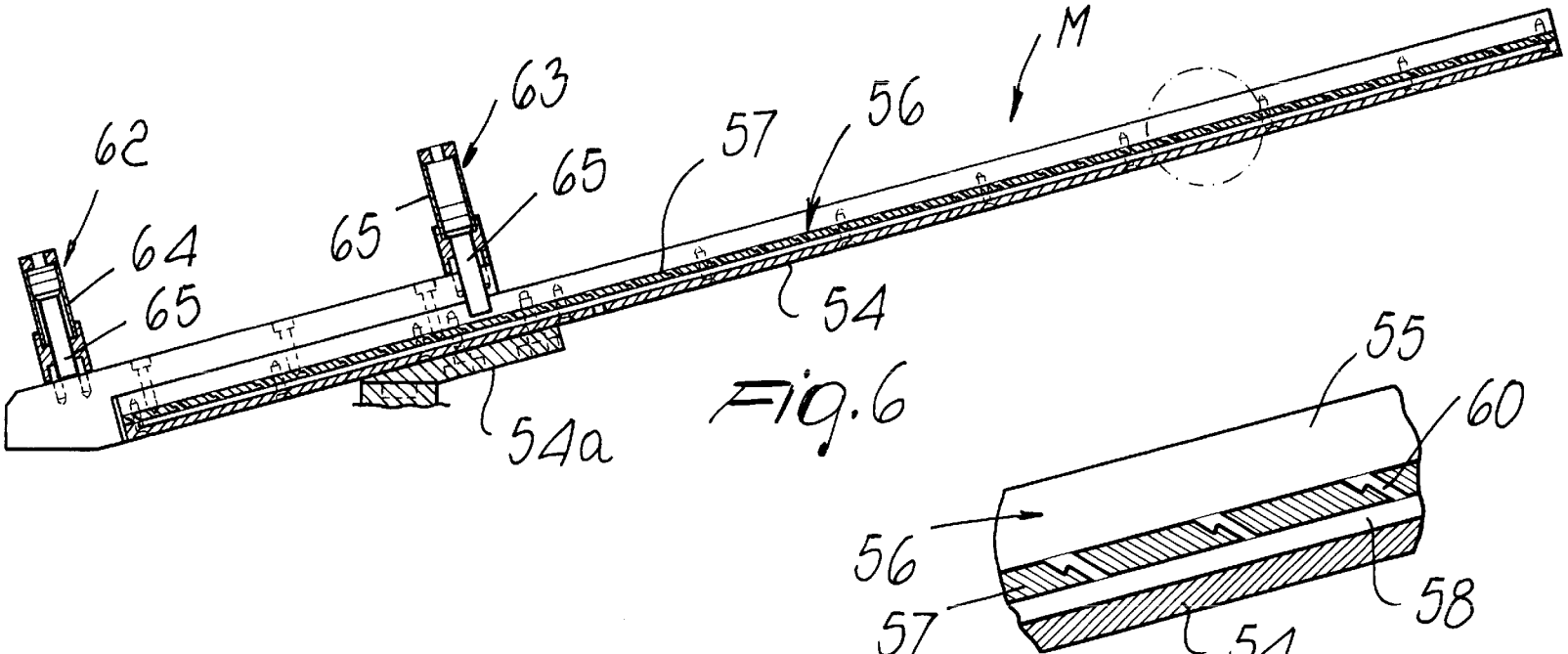
FIG. 6 is a sectional view of a channel for conveying the stapling members toward the stapling machine.
FIG. 7 is an enlarged-scale view of the detail enclosed in the circle of FIG. 6.
Figure 9:
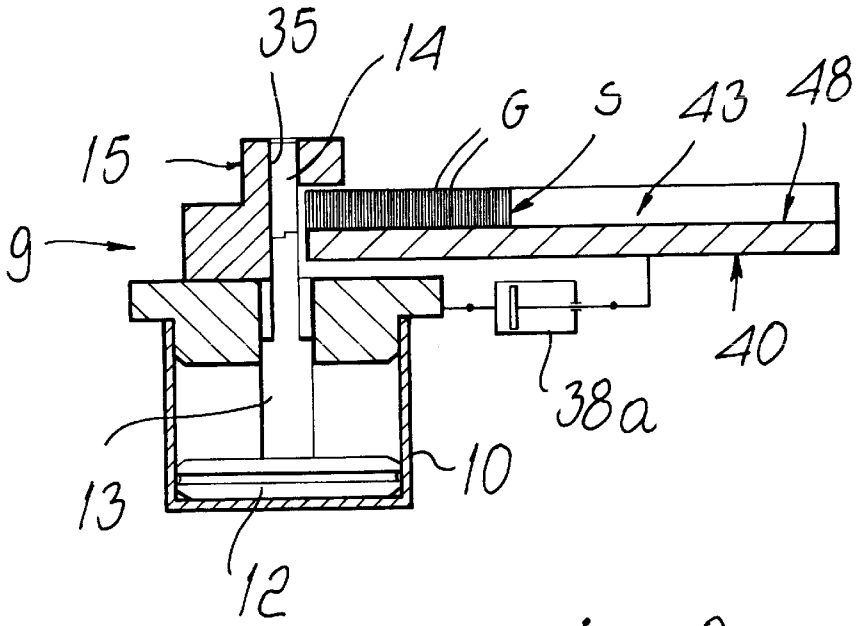
FIG. 9 is a schematic sectional view, taken along the line IX—IX of FIG. 8.

As shown more clearly in FIG. 6, the elements 62 and 63 are each constituted by a pneumatic cylinder 64 which has a piston whose stem 65 protrudes in order to lock the set S against the bottom 57 of the channel 56.

The operation of the described apparatus is as follows.

Figure 2:
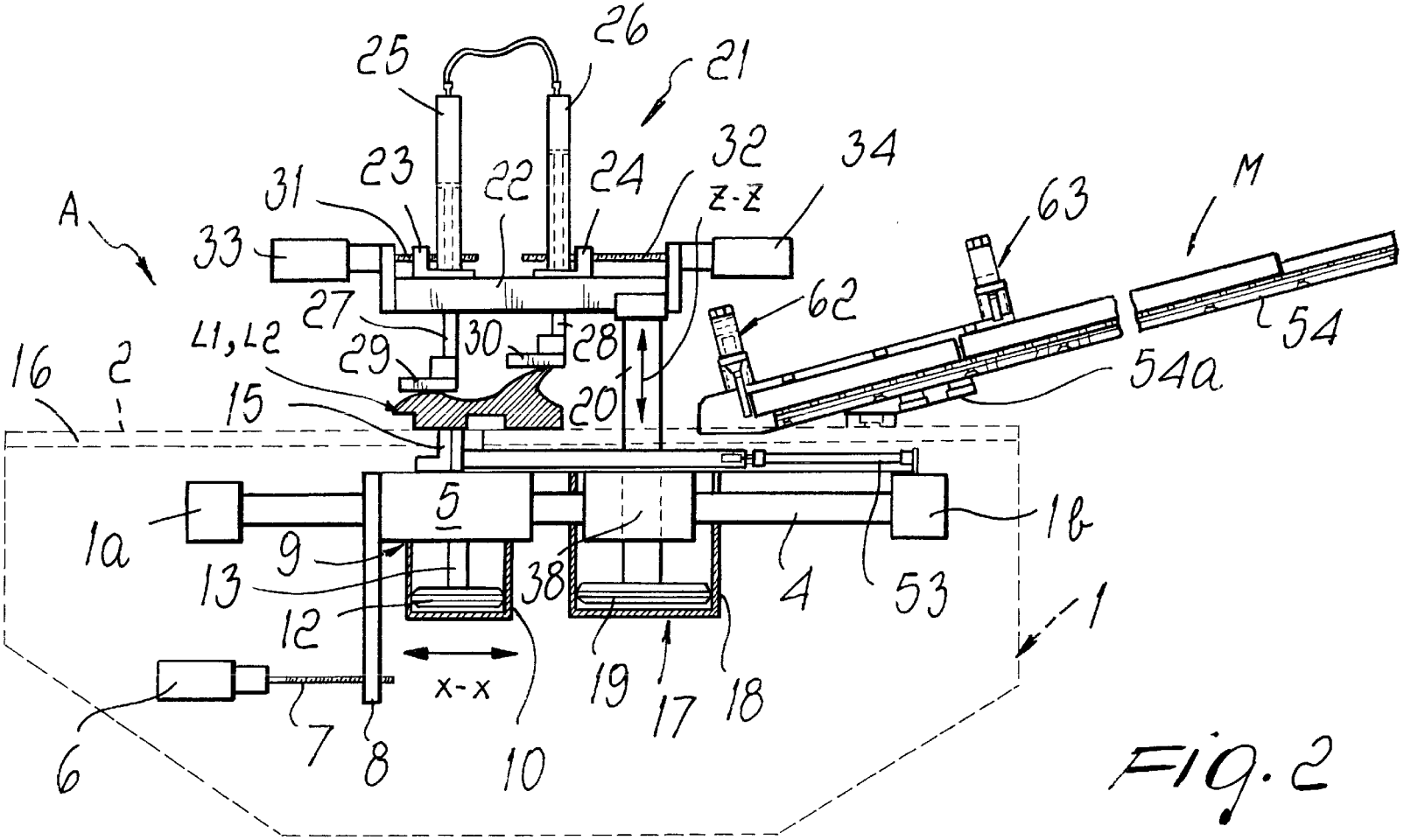
FIG. 2 is a sectional view of the assembling machine and of the apparatus.
Figure 3:
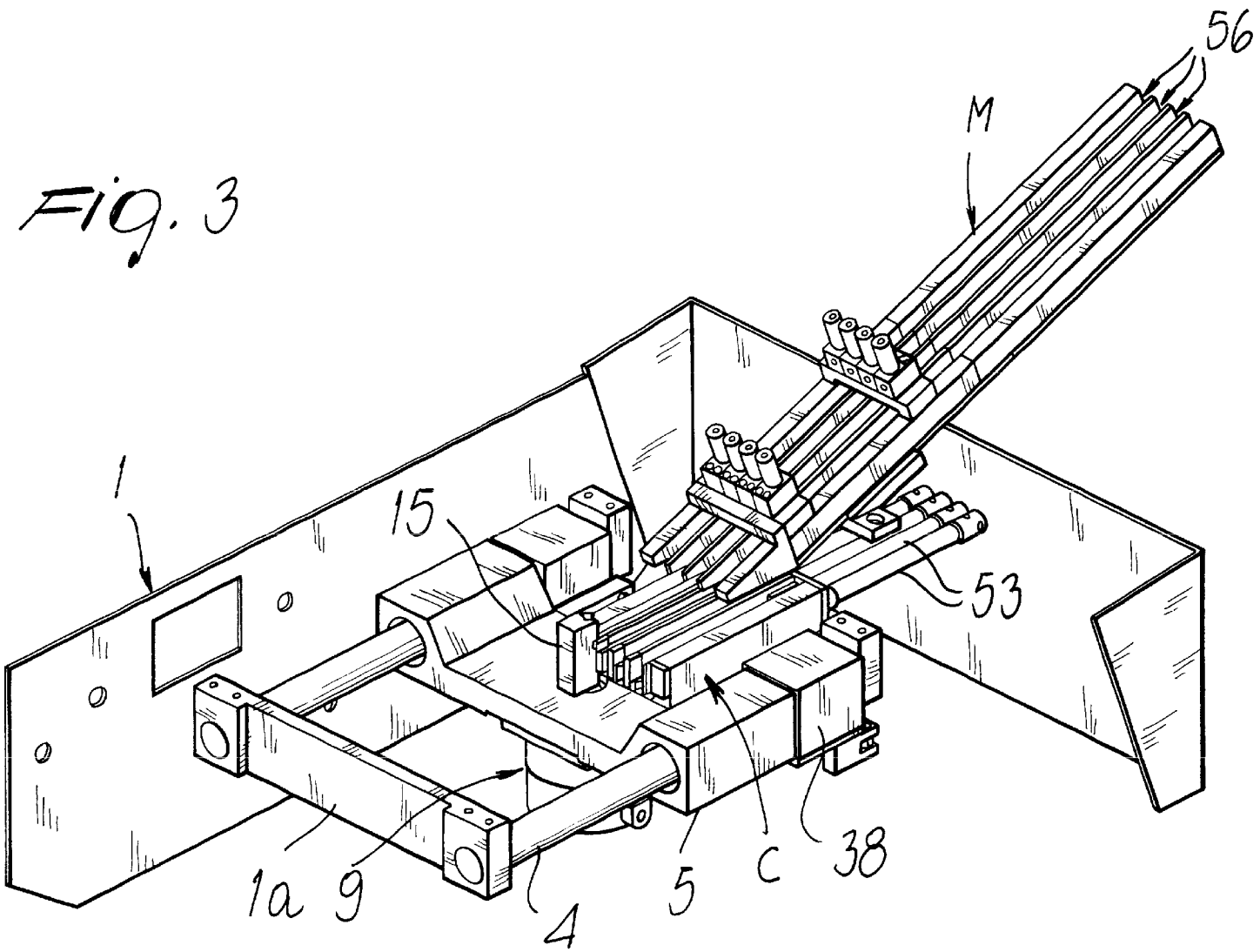
FIG. 3 is a perspective view of the apparatus.

Assume an initial situation in which the assembling machine A is in the position shown in FIG. 2, in which the strips L1 and L2 arranged at right angles against the L-shaped element 3 are locked by the pads 29 and 30 against the worktable 2 and must be joined one another by a set of three staples G which are inserted in succession astride the coupling line formed by the ends of the strips L1 and L2.

Assume, furthermore, that the magazine M and the holder C are empty.

First of all, the magazine M is filled by introducing in the channels 56 sets S of staples G having the intended dimensions and shape, according to what is required to ensure a firm coupling of the strips.

Rows of sets S thus form in the channels 56 and descend by gravity and due to the action of the compressed air fed through the passages 60, sliding on the bottoms 57 and stopping against the stems 65 of the retention elements 62. When the locking elements 63 are activated, the sets S that lie directly adjacent to the sets that abut against the stems of the elements 62 are locked.

At this point, by actuating the jacks 39 and 41, the holder C is moved into the position in which the seats 42–45 are aligned with the channels 56.

By raising the stems 65 of the retention elements 62, the lowermost sets S, i.e., the ones located downstream of the locking elements 63, are conveyed into the seats 42–45 by gravity and due to the compressed air, which forms a cushion under said sets which allows sliding.

At this point the pushers 53 intervene and push the sets S into abutment against the shoulders 50 and 51.

Then, by actuating the jacks 38*a* and 41, the seat that contains the staples G to be used to join the strips L1 and L2 is positioned in front of the channel 35 of the head 15. Finally, by making the sliding block 40 move in the direction X—X by means of the jack 38*a*, the sliding block 40 is moved toward the firing head 15, causing the engagement of the extensions 46*a*, 47*a* in the slots 36, 37 of the head 15 and the centering of the recess 49 against the channel 35 in order to form the guiding channel for the firing punch 14.

By keeping the jack 38*a* activated so as to retain the slider 38 adjacent to the carriage 5 and therefore keep the extensions 46*a* and 47*a* engaged in the slots 36 and 37, the stapling machine 9 is moved in order to place the punch 14 at the point of the joint of the strips where the first staple G of the intended set of three is to be inserted.

The movement of the stapling machine 9 is controlled by the motor 6, which acts on the carriage 5 on which the machine is mounted. It should be noted that during the strokes of the carriage 5 along the guides 4, the head 15 of the stapling machine 9 slides along the slot 16.

Once the first staple G has been inserted, the head 15 is moved, by way of successive movements of the carriage 5, to the points where the other two staples G are to be inserted.

The strips L1 and L2 thus joined are released by lifting the pads 23 and 24. The operating steps follow each other in the same manner for joining two successive strips.

A fundamental prerogative of the described apparatus is the fact that the magazine M can contain sets S of staples G having different shapes and dimensions and which, transferred into the seats 42–45 of the holder C, can provide a range of choice of the staples according to the characteristics of the strips to be joined.

The described machine is susceptible of numerous modifications and variations, all of which are within the scope of the appended claims.

In particular, the number of seats of the holder C and of the channels of the magazine M can vary according to requirements. Furthermore, the movements of the carriage 5, of the slider 38 and of the sliding block 40 can be controlled automatically on the basis of parameters obtained by reading the dimensional characteristics of the strips.

The disclosures in Italian Patent Application No. BO2000A000061 from which this application claims priority are incorporated herein by reference.

What is claimed is:

1. An apparatus for feeding stapling elements, grouped in sets, to a stapling machine provided with a striking punch adapted to insert the stapling elements astride a joint of strips arranged on a worktable of an assembling machine at an angle so as to form frames, the apparatus comprising:

a magazine composed of a plurality of inclined channels for accommodating in each a plurality of sets of stapling elements arranged in an aligned configuration, said inclined channels having downward outlets for said sets of stapling elements;

releasing means for individually releasing said sets of stapling elements from said inclined channels through said outlets;

a holder including a plurality of seats, which is arranged below said outlets of said inclined channels so as to receive in said seats respective, individual sets of stapling elements upon releasing thereof from said inclined channels, said holder being constituted by a sliding block in which said plurality of seats are provided adjacent and parallel one another, each one of said plurality of seats being shaped so as to receive a set of stapling elements of a size which is different from a size of the stapling elements of an adjacent seat, said sliding block being movable along transverse and axial directions so as to position said seats aligned with the outlets of said inclined channels, in order to receive said sets of stapling elements therefrom, and so as to arrange a seat of said plurality of seats that contains the stapling elements to be inserted with respect to the stapling machine in a position such as to provide the alignment of said punch with the stapling elements contained in said seat; and actuation means for actuating said holder between a position for receiving said sets of stapling elements from said channels in said seats and a position for positioning said sets of stapling elements with respect to said stapling machine so as to align the punch with the stapling elements to be inserted.

2. The apparatus of claim 1, for feeding staples to a stapling machine with a striking punch that has a guiding head provided with grooves, further comprising pushers arranged at said seats for pushing said stapling elements, said seats each including two parallel walls which extend so as to form two extensions having respective ends thereof provided with internal shoulders for abutment of the stapling elements contained in said seats, said pushers being arranged so as to actuate said stapling elements into abutment against said shoulders, with said extensions engaging in the grooves of the guiding head of the punch of said stapling machine.

3. The apparatus of claim 2, wherein said extensions arc provided so as to be convergent, and said grooves to be divergent in a complementary mode with respect to said convergent extensions.

4. The apparatus of claim 3, further comprising: a slider, first guides mounted on said slider; second guides fixed at the worktable of the assembling machine perpendicular to said first guides, with said holder being slideable on said first guides and said slider being slideable on said second guides; and movement means for moving said holder and said slider along said first and second guides, respectively, in order to position said seats with respect to said punch.

5. The apparatus of claim 2, wherein said releasing means comprise a retention element and a locking element, said retention element retaining a last set of stapling elements of a row of sets of stapling elements arranged in a selected one of said inclined channels, and said locking element locking a subsequent set of stapling elements that directly follows said last set of stapling elements, said retention and locking elements being actuatable so as to release each time a last set of stapling elements and retain subsequent ones.

6. The apparatus of claim 2, wherein said inclined channels of said magazine are constituted by a bottom with an inclined surface on which a plurality of parallel shoulders are provided, said bottom comprising an interspace in which compressed air from a compressed air source is introduced and a plurality of air passages oriented towards a descending direction of said inclined surface so that the compressed air passing through said air passages facilitates descent of said staple sets along said inclined channels.

7. In a frame assembling machine which comprises a worktable, a slider, first guides mounted on said slider; second guides fixed to said worktable perpendicularly to said first guides, said slider being slideable on said second guides; a stapling machine having a striking punch adapted to insert stapling elements astride a joint of strips arranged at an angle on the worktable to form frames, said stapling machine being slideable on said second guides;

an apparatus for feeding stapling elements, grouped in sets to the stapling machine, comprising:

a magazine composed of at least one inclined channel for accommodating a plurality of sets of stapling elements arranged in an aligned configuration, said at least one channel having a downward outlet for said sets;

releasing means for individually releasing said sets from said at least one channel through said outlet;

a holder including at least one seat, which is arranged below the outlet of said at least one channel and is movable along said first guides with respect to the outlet;

movement means for moving said holder and said slider between a position in which the holder receives in said at least one seat said sets of stapling elements from said at least one channel, and a position in which the holder positions a respective one of said sets of stapling elements received from said at least one channel, with respect to said stapling machine, so as to align the punch with the stapling elements to be inserted.

8. An apparatus for feeding stapling elements, grouped in sets, to a stapling machine provided with a striking punch adapted to insert the stapling elements astride a joint of strips arranged on a worktable at an angle to form frames the apparatus comprising:

a magazine composed of a plurality of inclined, adjacent channels for accommodating in each a plurality of sets of stapling elements arranged in an aligned configuration, said channels having downward outlets for letting out said staple sets;

releasing means for individually releasing said sets of stapling elements from said channels through said outlets;

a holder including a plurality of seats adapted to receive sets of stapling elements from said magazine, said holder being arrangeable below the outlets of said channels, said holder being constituted by a sliding block in which said plurality of seats are provided adjacent and parallel one another, said sliding block being movable along transverse and axial directions so as to position said seats aligned with the outlets of said inclined channels, in order to receive said sets of stapling elements therefrom, and so as to arrange a seat of said plurality of seats that contains the stapling elements to be inserted with respect to the stapling machine in a position such as to provide the alignment of said punch with the stapling elements contained in said seat; and movement means for moving said holder with respect to said channel outlets between a position for receiving from the channel outlets in said at least one seat a staple set and a position for positioning said staple set with respect to said stapling machine so as to align the punch with the stapling elements to be inserted.

9. The apparatus of claim 8, for feeding stapling elements to a stapling machine provided with a striking punch having a guiding head, further comprising pushers arranged at said seats for pushing said stapling elements, said seats each including two parallel walls which extend so as to form two extensions having respective ends thereof provided with internal shoulders for abutment of the stapling elements contained in said seats, said pushers being arranged so as to push said stapling elements into abutment against said shoulders, with said extensions engaging in grooves of the guiding head of the punch of said stapling machine.

10. The apparatus of claim 9, wherein said extensions are provided so as to be convergent, and said grooves to be divergent in a complementary mode with respect to said convergent extensions.

11. The apparatus of claim 9, further comprising: a slider, first guides mounted on said slider; second guides fixed to the worktable perpendicularly to said first guides, with said holder being slideable on said first guides and said slider being slideable on said second guides; and movement means for moving said holder and said slider along said first and second guides, respectively, in order to position said seats with respect to said punch.

12. The apparatus of claim 11, wherein said releasing means comprise a retention element and a locking element, said retention element retaining a last set of a row of said sets of stapling elements arranged in a selected one of said channel, and said locking element locking a subsequent set of stapling elements that directly follows said last set, said retention and locking elements being actuatable so as to release each time a last set of stapling elements and retain subsequent ones.

13. The apparatus of claim 12, wherein said inclined channels of said magazines are constituted by a bottom with an inclined surface on which a plurality of parallel shoulders are provided, said bottom comprising an interspace in which compressed air from a compressed air source is introduced and a plurality of air passages oriented towards a descending direction of said inclined surface so that the compressed air passing through said air passages facilitates descent of said staple sets along said inclined channels.

* * * * *